US008381789B2

(12) United States Patent
Payne

(10) Patent No.: US 8,381,789 B2
(45) Date of Patent: Feb. 26, 2013

(54) SECURING DEVICE FOR AN AUTOMATIC TAPER

(75) Inventor: Robert L. Payne, Lombard, IL (US)

(73) Assignee: Drywall Master Tools, Inc., Forest Park, IL (US)

( * ) Notice: Subject to any disclaimer, the term of this patent is extended or adjusted under 35 U.S.C. 154(b) by 170 days.

(21) Appl. No.: 13/025,699

(22) Filed: Feb. 11, 2011

(65) Prior Publication Data

US 2011/0198039 A1 Aug. 18, 2011

Related U.S. Application Data

(60) Provisional application No. 61/337,831, filed on Feb. 12, 2010.

(51) Int. Cl.
*B32B 37/22* (2006.01)
*B44C 7/02* (2006.01)

(52) U.S. Cl. ..... 156/577; 156/574; 225/79; 242/577

(58) Field of Classification Search ..... 156/574, 156/577, 579; 225/77, 79; 242/160.3, 170, 242/571, 571.3, 571.4, 571.5, 577, 577.2, 242/608, 611, 129.8, 134
See application file for complete search history.

(56) References Cited

U.S. PATENT DOCUMENTS

| | | | | |
|---|---|---|---|---|
| 3,109,570 | A * | 11/1963 | Maddalena | 225/66 |
| 3,393,790 | A * | 7/1968 | Dixon | 400/242 |
| 4,149,682 | A * | 4/1979 | Gustafson et al. | 242/571.3 |
| 5,161,781 | A * | 11/1992 | Sohocki | 254/30 |
| 5,480,106 | A * | 1/1996 | Voissem | 242/571 |
| 5,628,475 | A * | 5/1997 | Warnaar | 242/571.4 |
| 5,820,069 | A * | 10/1998 | Segura Salvador et al. | 242/571.3 |
| 2004/0159406 | A1* | 8/2004 | Jungklaus | 156/577 |
| 2004/0216847 | A1* | 11/2004 | Hall et al. | 156/575 |
| 2005/0061449 | A1* | 3/2005 | Jungklaus | 156/574 |
| 2006/0219366 | A1* | 10/2006 | Smythe et al. | 156/574 |
| 2007/0044923 | A1* | 3/2007 | Jungklaus et al. | 156/575 |
| 2007/0215289 | A1* | 9/2007 | Kennedy | 156/577 |
| 2011/0027009 | A1* | 2/2011 | Kusiak et al. | 403/11 |

* cited by examiner

*Primary Examiner* — Mark A Osele
(74) *Attorney, Agent, or Firm* — Justin Lampel

(57) ABSTRACT

An automatic drywall taper is provided. The automatic drywall taper has a securing device for securing drywall tape to the body of the taper during use. The securing device has an elongated bar which runs substantially parallel to the body of the taper. The elongated bar is spring activated to lock a hub on a bar which is attached substantially perpendicular to the body of the taper. The hub rotates thereby allowing the tape to dispense and be used on drywall. The hub has a braking mechanism which allows for the controlled release of the tape.

3 Claims, 4 Drawing Sheets

SECURING DEVICE FOR AN AUTOMATIC TAPER

CROSS REFERENCE TO RELATED APPLICATIONS

The present application claims the priority benefit of U.S. Provisional Application 61/337,831, filed on Feb. 12, 2010, which is hereby incorporated by reference in its entirety.

BACKGROUND OF THE INVENTION

An automatic drywall taper is provided. The automatic drywall taper has a securing device for securing drywall tape to the body of the taper during use. The securing device has an elongated bar which runs substantially parallel to the body of the taper. The elongated bar is spring activated to lock a hub on a bar which is attached substantially perpendicular to the body of the taper. The hub rotates thereby allowing the tape to dispense and be used on drywall. The hub has a braking mechanism which allows for the controlled release of the tape.

Drywall tapers have been around for a long time. For example, U.S. Pat. No. 4,828,647 to Eccleston discloses a taper for applying tape and mastic to joints between prefabricated wall sections such as gypsum board comprising a tubular housing which holds a supply of mastic, a main drive roller mounted at the forward end of the housing which rotates by friction as it is moved along a wall and tape drive roller means operated by the main drive roller and which feeds the tape forwardly.

U.S. Pat. No. 6,513,562 to Trout discloses a unitary nozzle for use in a taping apparatus. The unitary nozzle features a cradle section adjacent a tube receiving section and a flange for sealingly receiving a mastic tube. A mastic is extruded and contained along a path extending along one side of the tape and between a front and rear end of the nozzle.

U.S. Pat. No. 4,086,121 to Ames discloses a self-contained dry wall taper has a hollow elongated body for holding mastic and supports a roll of tape with tape feeding means to deliver the tape to tape applying wheels that in turn apply it to cover a joint between two wall board sections. A piston is slidably mounted in the hollow body and is automatically moved by a mechanism actuated by the rotating wheels, as they are moved over the wall board surface, to force a layer of mastic onto the tape just prior to it being applied to the surface. Novel tape feeding and tape cutting means are actuated by a single sleeve which is moved forwardly on the hollow body to initially feed the tape into engagement with the tape applying wheels and is moved rearwardly to actuate the tape-cutting mechanism for cutting the tape. A tape creasing disc can be swung into operative position by the operator when the tape is to be applied to an inner corner of a room and it is desired to provide a median crease along the length of the tape and for forcing this crease into the room corner as the mastic and tape are applied.

However, these existing devices fail to provide an automatic drywall taper having a securing device for easily reloading and securing drywall tape to the body of the taper during use. The securing device has an elongated bar which runs substantially parallel to the body of the taper. The elongated bar is spring activated to lock a hub on a bar which is attached substantially perpendicular to the body of the taper. The hub rotates thereby allowing the tape to dispense and be used on drywall. The hub has a braking mechanism which allows for the controlled release of the tape. A need, therefore, exists for an improved automatic taper which accomplishes the controlled release of drywall tape for use on drywall.

SUMMARY OF THE INVENTION

The invention generally relates to an automatic taper for drywall. More specifically, the invention relates to an automatic drywall having a securing device for securing drywall tape to the body of the taper during use. The securing device has an elongated bar which runs substantially parallel to the body of the taper. The elongated bar is spring activated to lock a hub on a bar which is attached substantially perpendicular to the body of the taper. The hub rotates thereby allowing the tape to dispense and be used on drywall. The hub has a braking mechanism which allows for the controlled release of the tape.

The automatic taper is used to provide tape to joints between pre-fabricated drywall. An advantage of the device is to provide a light weight and convenient automatic taper.

A further advantage of the device is to provide an automatic taper having a spring loaded bar for securing drywall tape onto the hub of the taper body.

Another advantage is the easy removal of the tape during reloads since the elongated bar is unlatched in one motion.

And, another advantage of the device is to provide a drywall taper which has a hub having a breaking mechanism for controlled release of the tape onto the drywall.

Still a further advantage of the present invention is to provide an automatic taper having a slit in the hub wherein the slit may be expanded or contracted by the user to increase or reduce friction of the tape on the hub.

Yet another advantage of the present invention is to provide a taper wherein the taper has screws which allow a user to easily alter the friction of the breaking system of the hub.

For a more complete understanding of the above listed features and advantages of the automatic taper, reference should be made to the following detailed description of the preferred embodiments and to the accompanying drawings. Further, additional features and advantages of the invention are described in, and will be apparent from, the detailed description of the preferred embodiments and from the drawings.

DETAILED DESCRIPTION OF THE PREFERRED EMBODIMENTS

An automatic drywall taper is provided. The automatic drywall taper has a securing device for securing drywall tape to the body of the taper during use. The securing device has an elongated bar which runs substantially parallel to the body of the taper. The elongated bar is spring activated to lock a hub on a bar which is attached substantially perpendicular to the body of the taper. The hub rotates thereby allowing the tape to dispense and be used on drywall. The hub has a braking mechanism which allows for the controlled release of the tape.

Figure 1:
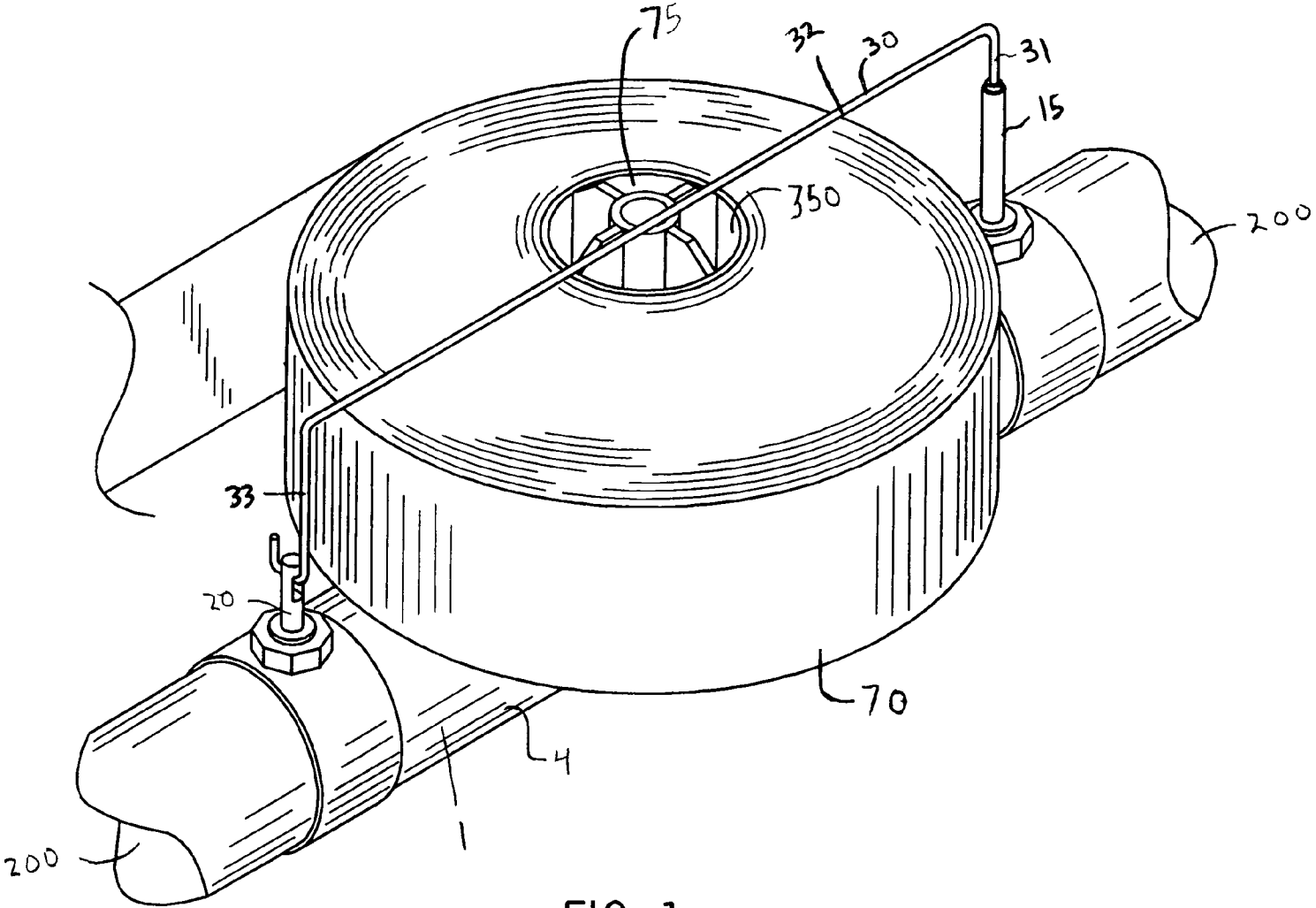
FIG. 1 illustrates a side perspective view of the drywall taper with drywall tape secured on the same.

Referring now to FIG. 1, the automatic taper 1 may have a first end, a second end and a body 4. The body 4 may be a desired length to, for example, telescopically expand to reach high ceilings and walls. Typically, the automatic taper 1 would be constructed from metal components which are secured together by screws and the like; however, it should be noted that the device may be constructed from any other suitable material aside from metal. The first end of the automatic taper 1 may be the portion of the device which the user grasps and controls the functions of the device while the second end of the automatic taper 1 may be the business end of the automatic taper 1 and may have a nozzle (not shown). The body 4 of the automatic taper 1 may be a generally hollow tube having an interior 200. Preferably, the body 4 is cylindrical in shape; however, the body 4 may be of any suitable shape.

Located within the hollow body 4 may be a passageway for mud (or mastic) to travel. More specifically, the mud may move upward from the first end of the automatic taper 1 to the second end of the automatic taper 1. A supply line of new mud may constantly replace the mud as it moves from the first end to the second end and out of the front of the nozzle and into the drywall board joint. The nozzle is used to apply both tape 70 and mud to the joint between two pre-fabricated drywall boards.

Figure 3:
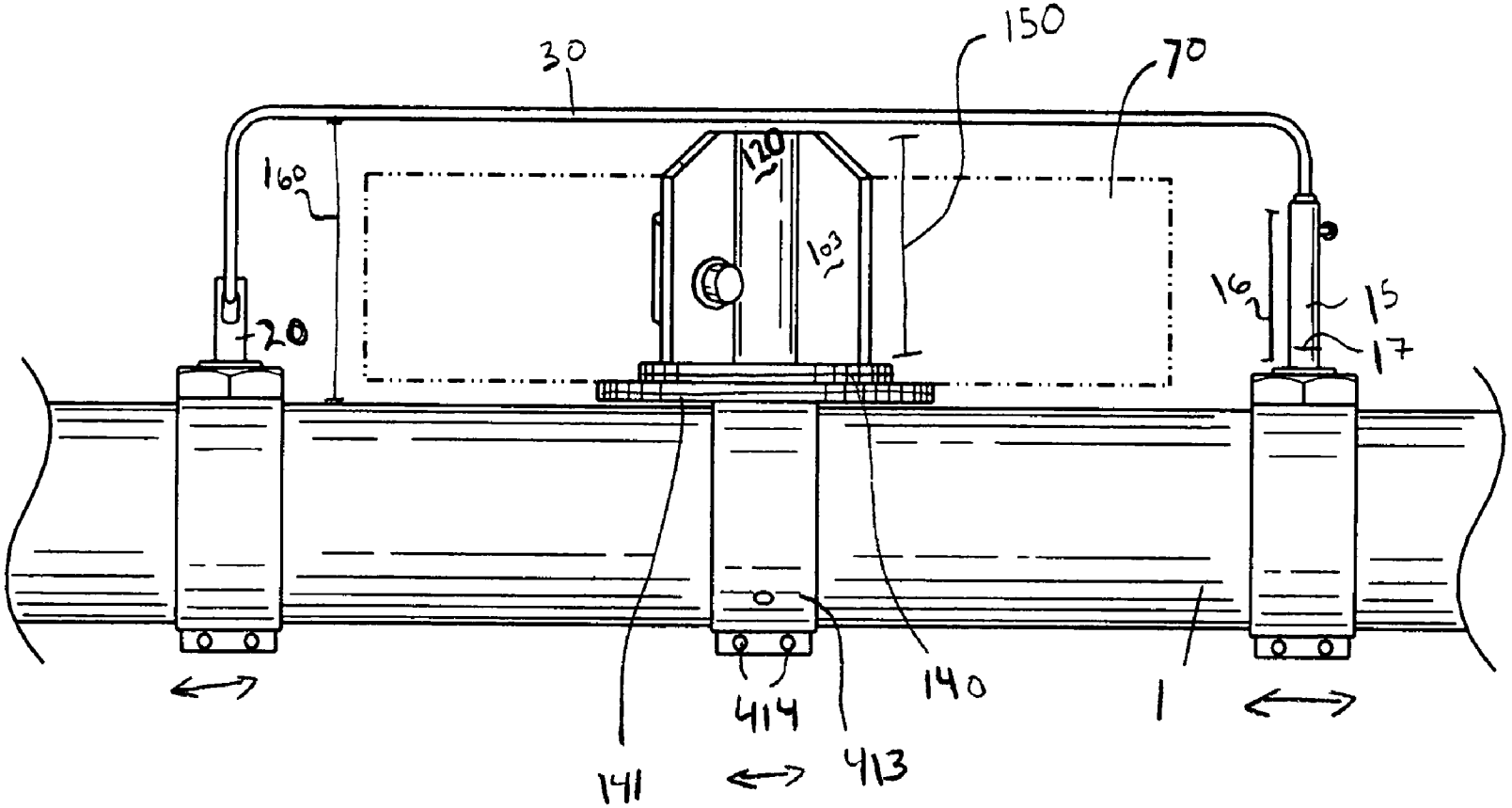
FIG. 3 illustrates a side plan view of the drywall taper.

Along the body 4 of the drywall taper 1 (located on a generally circular band 415 as described below) may be a first support cylinder 15. The first cylinder 15 may be substantially perpendicular to the body 4 of the taper 1. The first cylinder 15 may have a height 16 and a diameter 17 (FIG. 3). Also located on a generally circular band 415 of the body 4 of the drywall taper 1 may be a second cylinder 20. The second cylinder 20 may be located largely perpendicular to the body 4 of the drywall taper 1 and largely parallel to the first cylinder 15. The second cylinder 20 may have a height 21 and a diameter 22.

A securing bar 30 may be permanently secured to the first cylinder 15 and removably attached to the second cylinder 20. More specifically, the securing bar 30 may have a first portion 31, a second portion 32 and a third portion 33. The first portion 31 and the third portion 33 may be largely parallel to each other (and also largely parallel to the first cylinder 15 and second cylinder 20) while the second portion 32 may be largely parallel to the body 4 of the taper 1. As a result, the securing bar 30 may form an elongated "U" shape. The first portion 31 of the securing bar 30 may be partially inserted permanently within the first cylinder 15 such that the securing bar 30 may rotate 360 degrees with respect to the first cylinder 15. More specifically, while the second portion 32 of the securing bar 30 and the third portion 33 move with respect to the first cylinder 15, the first portion 31 of the securing bar 30 may remain stationary and may rotate within the first cylinder 15. While the securing bar 30 is extended over a diameter of the tape 70 (and center of the hub 75 as described below), the securing bar 30 may secure the tape 70 near the body 4 of the automatic taper 1.

Figure 2:
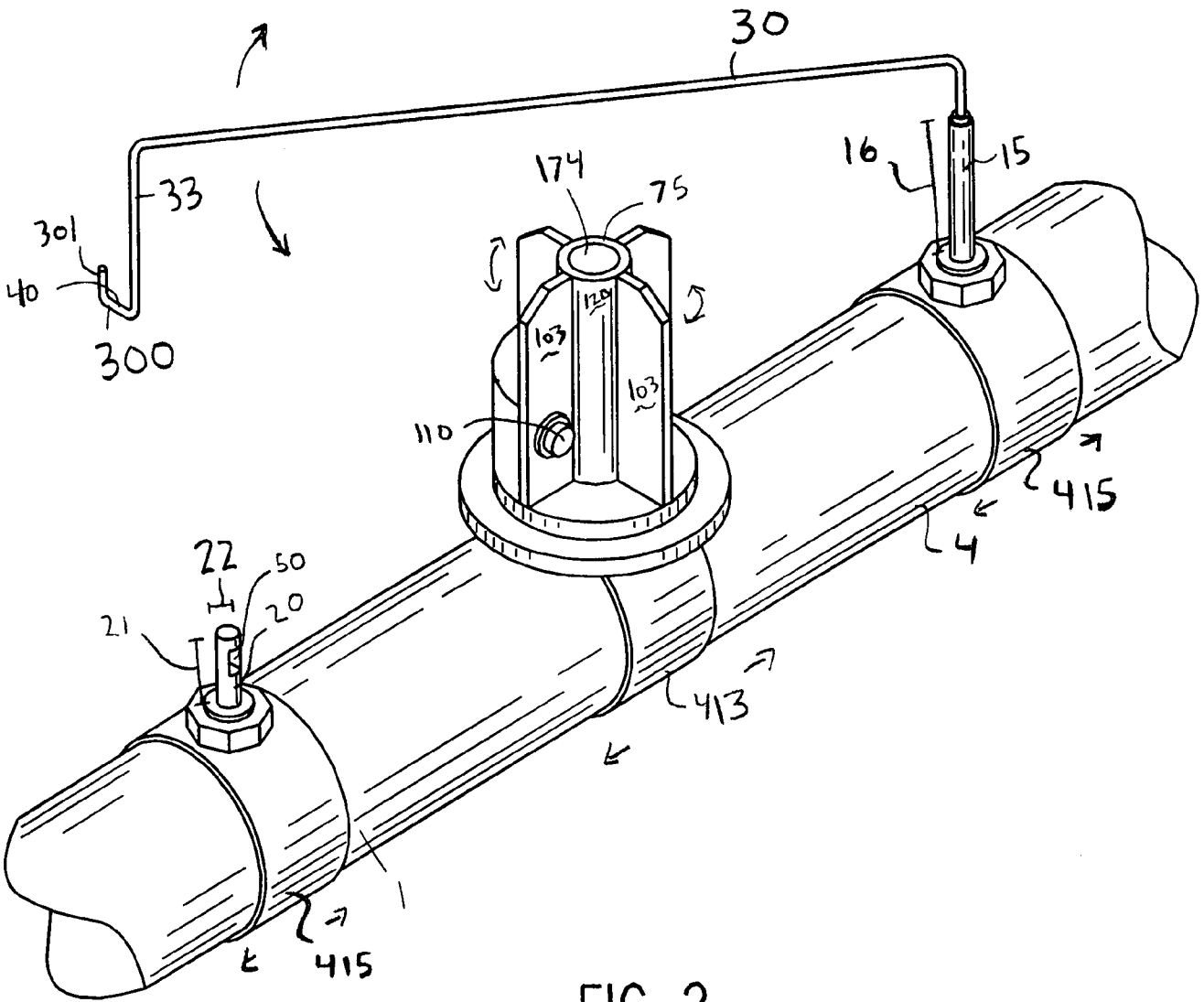
FIG. 2 illustrates a side perspective view of the automatic taper wherein the drywall tape is removed.

Referring now to FIG. 2, the third portion 33 of the securing bar 30 may have a hook portion 40. The hook portion 40 may be inserted into an opening 50 near the top of and in the second cylinder 20. The securing bar 30 may be spring loaded so that when the hook 40 is inserted into the opening 50 in the second cylinder 20, the securing bar 30 may be locked into place and stationary as a result of, for example, friction. When the user wishes to remove the securing bar 30 from the second cylinder 20, the user may depress the hook 40 from the opening 50 by applying downward pressure to overcome the spring action. The hook 40 may then be released from the opening 50 and the securing bar may now rotate with respect to the first cylinder 15.

The hook 40 of the securing bar 30 may be generally u-shaped. More specifically, the hook 40 may have a generally flat bottom portion 300 and an upward-pointing shaft 301. The upward-pointing shaft 301 may extend upward at approximately ninety degrees with respect to the generally flat bottom portion 300. When inserted into the opening 50 of the second cylinder 20, the generally flat bottom portion 300 may contact and be secured to an upper contact surface within the opening 50 of the second cylinder 20.

When the hook 40 of the securing bar 30 is locked into position within the opening 50 of the second cylinder 20, tape 70 may be secured onto a hub 75 of the automatic taper 1. More specifically, when the hook 40 is locked into position in the opening 50 of the second cylinder 20, the securing bar 30 may act as a barrier to prevent the tape 70 from moving away from the hub 75 and body 4 of the taper 1. When a user needs to change a roll of tape 70, the user may remove the hook 40 from the opening 50 of the second cylinder 20, thereby moving the securing bar 30 and freeing the empty tape roll on the hub 75 for exchange with a new roll of tape 70.

During use, the hook 40 may be locked within the opening 50 of the second cylinder 20 as a result of being spring loaded. More specifically, spring pressure is created as a result of the generally flat bottom portion 300 remaining at a resting point at a distance farther away from the body 4 then the distance from the body 4 to the upper contact surface within the opening 50 of the second cylinder 30. As a result, force must be applied to force the hook 40 into the opening 50 of the second cylinder 20.

The hub 75 of the taper 1 may extend outward from the body 4 of the taper 1 in a largely perpendicular position with respect to the body 4 of the taper 1. The hub 75 may rotate 360 degrees along the side of the body 4 of the taper 1. The rotation of the hub 75 allows the tape 70 to be dispensed for use in the preparation of the drywall.

Figure 4:
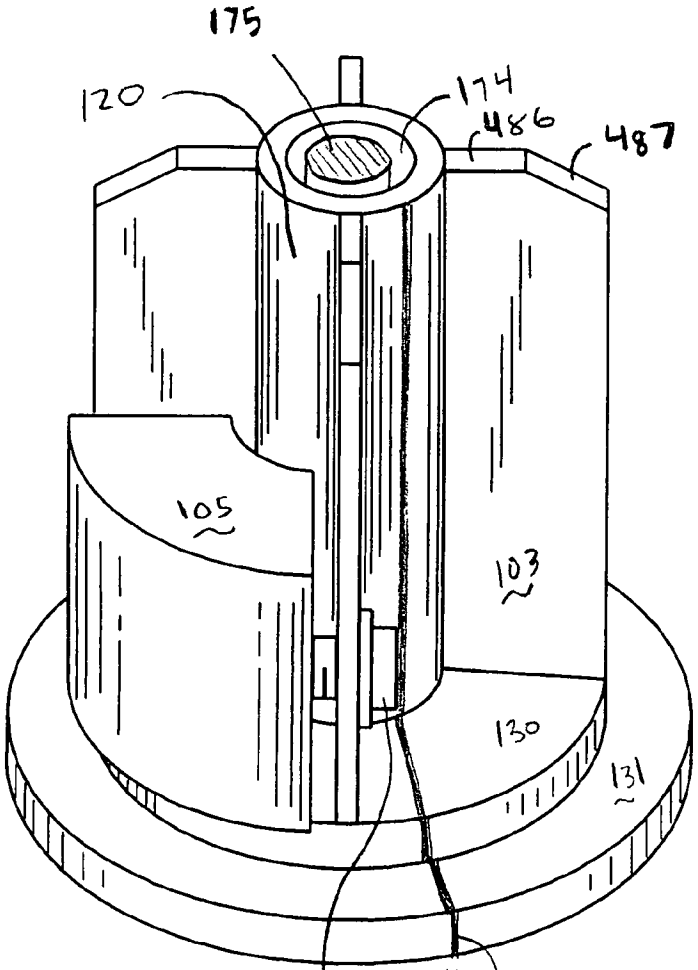
FIG. 4 illustrates a front perspective view of the hub of the automatic taper.

The hub 75 of the taper 1 may have a plurality of extended planar surfaces 103. The extended planar surfaces 103 may have a top edge 486 (FIG. 4) having a tapered edge 487 which may allow for easy insertion of the tape 70 over the hub 75. FIG. 4 illustrates four planar surfaces 103, although any suitable number of planar surfaces 103 may be implemented. The planar surfaces 103 may extend largely outward from a central cylindrical column 120 of the hub 75. The central cylindrical column 120 may have an opening 174 which may rotate around a stationary shaft 175. The stationary shaft 175 may be permanently secured to the body 4 of the taper 1 (via a generally circular band 413). The stationary shaft 175 may be substantially perpendicular with respect to the body 4 of the taper 1. As a result, the hub 75 may rotate around the shaft 175. The central cylindrical column 120 may have a height 150 which is slightly less than a height 160 of the distance from the body 4 of the taper 1 to the securing bar 30.

The hub 75 of the taper 1 may have a first generally flat surface 130 (FIG. 4) and a second generally flat surface 131; both of which run perpendicular to the planar surfaces 103. The second generally flat surface 131 may support and hold the tape 70 and may allow the tape 70 to rotate 360 degrees around the central cylindrical column 120. The first generally flat surface 130 may have a diameter 140 which is less than a diameter 141 of the second generally flat surface 131. The first generally flat surface 130 may be located father away from the body 4 of the taper 1 than the second generally flat surface 131. As stated above, while in use, the tape 70 may rest substantially on the second generally flat surface 131 of the hub 75 and the first generally flat surface 130 may be partially located within an interior diameter opening of the tape 70.

In an embodiment, along the central cylindrical column 120, the first generally flat surface 130 and second generally flat surface 131 may be a slit 100. The slit 100 may simply be an opening that runs from the outer circumference of the second generally flat surface 131, through the first generally flat surface 130 toward the center of the hub 75 and then up the central cylindrical column 120. The slit 100 may be expanded or contracted so as to control the circumference of the hub 75.

The hub 75 of the taper 1 is preferable made of plastic; however, any suitable material may be used. The slit 100 may also be easily expanded or contracted to produce more or less friction with respect to the shaft 175 of the taper 1. A brake 105 may be located between two of the plurality of planar surfaces 103. More specifically, the brake 105 may temporarily contact two of the planar surfaces 103. In an embodiment, a portion of the slit 100 may be obscured by the brake 105.

Figure 5:
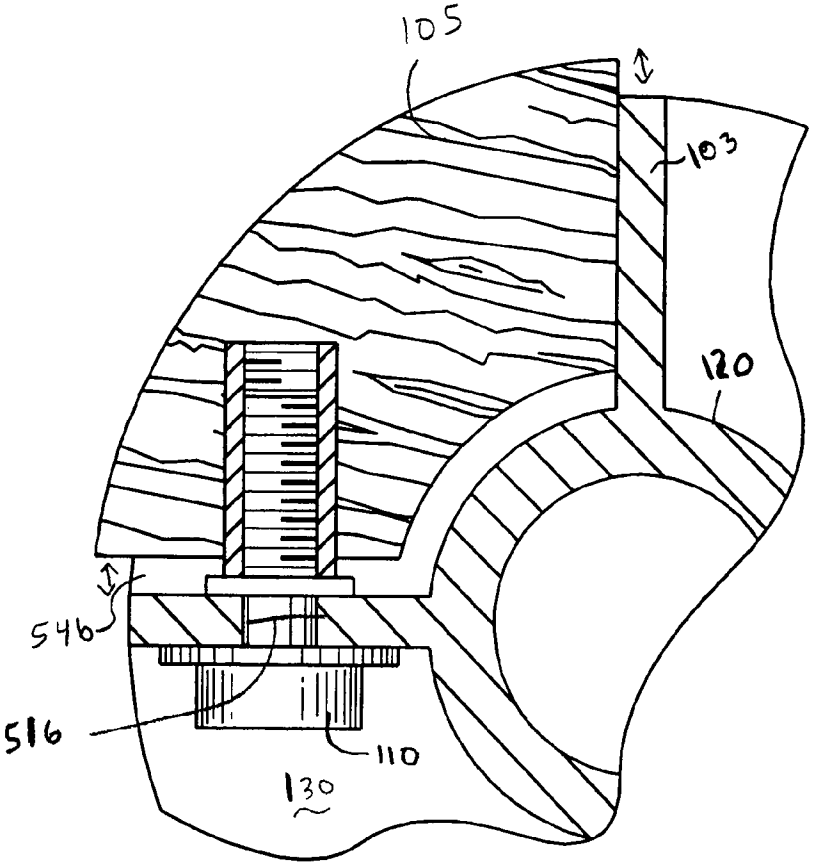
FIG. 5 illustrates a top plan view of the hub of the automatic taper wherein the brake is adjusted.

A screw 110 may be inserted through a generally circular opening 516 on the side of one of the planar surfaces 103 and may extend into the brake 105. As illustrated in FIG. 5, when the screw(s) 110 are tightened, a space 546 between the brake 105 and the planar surface 103 is altered. More specifically, the screw 110 may be relaxed, therein forcing the brake 105 outward, away from the planar surfaces 103. As a result, the outwardly moving brake 105 may create a generally greater total diameter of the hub 75 than the normal diameter 140 defined by the generally first planer surface 130. As the brake 105 is expanded outward, pressure is created on an inner wall 350 (FIG. 1) of the tape 75 therein preventing the tape 75 from rotating independently from the hub 75. Further, the outwardly expanding diameter of the hub 75 created by the brake 105 allows for tapes 75 of various sizes to be accommodated on the hub 75. A user may also reduce the pressure on the inner wall 350 of the tape 70 by reversing the distance of the brake 105 from the planar surfaces 103 by manipulating the screw 110 in the opposite direction. The user may also tighten or loosen the screw(s) 110 of the taper 1 to either allow the tape 70 to easily rotate around the hub 75 or to rotate around the hub 75 in a slower manner.

In the embodiment wherein the slit 100 is implemented, when the size of the slit 100 of the hub 75 is increased, less friction is created between the hub 75 and the shaft 175 and the hub 75 may rotate more easily. When the screw(s) 110 are tightened, the distance between the brake 105 and the planar surface 103 is decreased and, therefore the width 180 of the slit 100 is decreased. When the width 180 of the slit 100 is decreased, the friction of the hub 75 around the shaft 175 is increased and the hub 75 may rotate more slowly. As a result, the tape 70 on the hub 75 may rotate less slowly when the screw(s) 110 are tightened.

Located on the body 4 of the automatic taper 1 may be a generally circular band 413 (FIG. 2). The generally circular band 413 may cover a portion of the exterior body 4 of the automatic taper 1. The generally circular band 413 may be directly connected to the shaft 175 of the hub 75 and may provide additional support for the weight of the hub 75 and the weight of the tape 70 so that the hub 75 and the tape 70 may easily rotate around the shaft 175. In an embodiment, the generally circular band 413 may be tightened or loosened via a screw 414 (FIG. 3). When loosened, friction is reduced and the generally circular band 413 may slide up or down the body 4 of the taper 1 so as to allow the user to determine the location of the hub 75 and tape with respect to the body 4 of the taper 1. Further, generally circular bands 415 may also be secured to the first support cylinder 15 and second support cylinder 20 so as to also allow the respective cylinders 15, 20 to move up or down the body 4 of the taper 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages. It is, therefore, intended that such changes and modifications be covered by the appended claims.

I claim:

1. A tape securing device for an automatic taper comprising:

a rotating hub having a generally circular first flat surface;

a generally cylindrical body located on the rotating hub wherein the generally cylindrical body has a plurality of planar surfaces extending outward from the generally cylindrical body and wherein the plurality of planar surfaces are located substantially perpendicular with respect to the generally circular first flat surface and wherein the rotating hub rotates around a shaft and wherein a drywall tape is placed on the generally circular first flat surface and at least partially around the plurality of planar surfaces; and a generally wedge-shaped brake located between two of the plurality of planar surfaces of the hub wherein the generally wedge-shaped brake moves from a first position to a second position and wherein the movement of the generally wedge-shaped brake from the first position to the second position alters a diameter of the hub and therein accommodates tapes of various sizes.

2. A tape securing device for an automatic taper comprising:

a rotating hub having a generally circular first flat surface;

a generally cylindrical body located on the rotating hub wherein the generally cylindrical body has a plurality of planar surfaces extending outward from the generally cylindrical body and wherein the plurality of planar surfaces are located substantially perpendicular with respect to the generally circular first flat surface and wherein the rotating hub rotates around a shaft and wherein a drywall tape is placed on the generally circular first flat surface and at least partially around the plurality of planar surfaces;

a generally wedge-shaped brake located between two of the plurality of planar surfaces of the hub wherein the generally wedge-shaped brake moves from a first position to a second position and wherein the movement of the generally wedge-shaped brake from the first position to the second position alters a diameter of the hub and therein accommodates tapes of various sizes; and a screw extending through an opening in one of the plurality of planar surfaces and partially through the generally wedge-shaped brake wherein the movement of the screw moves the generally wedge-shaped brake from a first position to a second position.

3. A tape securing device for an automatic taper comprising:

a rotating hub having a generally circular first flat surface;

a generally cylindrical body located on the rotating hub wherein the generally cylindrical body has a plurality of planar surfaces extending outward from the generally cylindrical body and wherein the plurality of planar surfaces are located substantially perpendicular with respect to the generally circular first flat surface and wherein the rotating hub rotates around a shaft and wherein a drywall tape is placed on the generally circular first flat surface and at least partially around the plurality of planar surfaces;

a generally wedge-shaped brake located between two of the plurality of planar surfaces of the hub wherein the generally wedge-shaped brake moves from a first position to a second position and wherein the movement of the generally wedge-shaped brake from the first position to the second position alters a diameter of the hub and therein accommodates tapes of various sizes; and a screw extending through an opening in one of the plurality of planar surfaces and partially through the generally wedge-shaped brake wherein the movement of the screw moves the generally wedge-shaped brake from a first position to a second position wherein the movement of the generally wedge-shaped brake from a first position to a second position controls a speed of rotation of a tape around the hub.

* * * * *